United States Patent [19]

Esteban et al.

[11] Patent Number: 4,983,131

[45] Date of Patent: Jan. 8, 1991

[54] PRE-MOLDED ELECTRICAL PLUG BODY

[75] Inventors: Bernardo L. Esteban; Efrain B. Hernandez, both of Guanajuato, Mexico

[73] Assignee: Woods Wire Products, Inc., Carmel, Ind.

[21] Appl. No.: 463,420

[22] Filed: Jan. 11, 1990

[51] Int. Cl.[5] ..... H01R 13/58

[52] U.S. Cl. ..... 439/456; 29/883; 439/600

[58] Field of Search ..... 439/449, 456, 460, 465, 439/599, 600, 660, 696; 29/842, 877, 883

[56] References Cited

U.S. PATENT DOCUMENTS

| | | | |
|---|---|---|---|
| 2,027,853 | 1/1936 | Benander | 439/456 |
| 2,705,309 | 3/1955 | Bramming | 439/465 X |
| 3,482,204 | 12/1969 | Grunbaum | 439/460 X |
| 4,781,614 | 1/1988 | Ahroni | 439/696 X |

FOREIGN PATENT DOCUMENTS

| | | | |
|---|---|---|---|
| 2124833 | 2/1984 | United Kingdom | 439/449 |

*Primary Examiner*—Eugene F. Desmond

*Attorney, Agent, or Firm*—Woodard, Emhardt, Naughton Moriarty & McNett

[57] ABSTRACT

A pre-molded electrical plug body to house male electrical blades and electrical plug wires, comprising a pair of identical pre-molded electrical plug body pieces mated together, each piece having blade receiving means for snugly receiving male electrical blades, a pair of posts nested together with corresponding posts of the mating piece to form a central pillar around which electrical plug wires are led to the male electrical blades, and a pair of pins received into corresponding recesses of the mating piece that cooperate with the pair of posts to arrest therebetween electrical plug wires led to the male electrical blades; and a method of manufacturing an electrical plug having a body formed from two identical pre-molded pieces.

9 Claims, 2 Drawing Sheets

PRE-MOLDED ELECTRICAL PLUG BODY

The present invention relates generally to the field of electrical plugs, which are male fittings for making electrical connections by their insertion into a receptacle, and more particularly to electrical plug bodies that are manufactured from pre-molded pieces.

SUMMARY OF THE INVENTION

One embodiment of the present invention is a pre-molded electrical plug body to house male electrical blades and electrical plug wires, comprising a pair of identical pre-molded electrical plug body pieces mated together, each piece having blade receiving means for snugly receiving male electrical blades, a pair of posts nested together with corresponding posts of the mating piece to form a central pillar around which electrical plug wires are led to the male electrical blades, and a pair of pins received into corresponding recesses of the mating piece that cooperate with the pair of posts to arrest therebetween electrical plug wires led to the male electrical blades.

Another embodiment of the present invention is a pre-molded electrical plug body piece to house male electrical blades and electrical plug wires when mated with an identical pre-molded electrical plug body piece, comprising blade receiving means for snugly receiving male electrical blades, a pair of central posts around which electrical plug wires are led to the male electrical blades, and a pair of pins cooperating with said pair of posts to arrest therebetween electrical plug wires led to the male electrical blades.

Another embodiment of the present invention is a method of forming a pre-molded electrical plug body to house male electrical blades and electrical plug wires, comprising the steps of providing a pair of identical pre-molded electrical plug body pieces to be mated, each piece having blade receiving means for snugly receiving male electrical blades, a pair of posts to nest together with corresponding posts of the mating piece to form a central pillar around which electrical plug wires are led to the male electrical blades, and a pair of pins to be received into corresponding recesses of the mating piece that cooperate with the pair of posts to arrest therebetween the electrical plug wires led to the male electrical blades; inserting male electrical blades and electrical plug wires within one of the pre-molded electrical plug body pieces; mating the other pre-molded electrical plug body piece to the piece within which male electrical blades and electrical plug wires have been inserted; and welding the mated pre-molded electrical plug body pieces together.

It is an object of the present invention to provide a pre-molded electrical plug body formed by joining together two identical pre-molded pieces, thereby eliminating the need to pre-mold two differently configured body pieces.

Related objects and advantages of the present invention will become apparent from the following description.

DESCRIPTION OF THE PREFERRED EMBODIMENT

Figure 1:
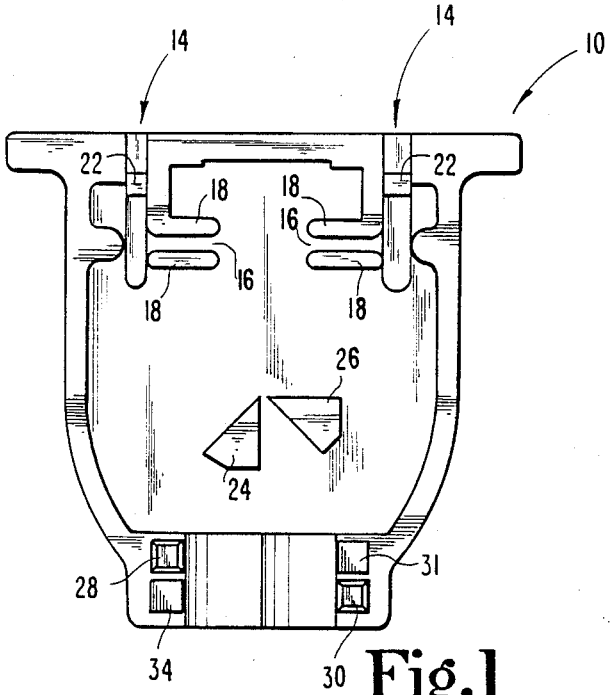
FIG. 1 is a top plan view of a pre-molded electrical plug body piece of the present invention.
Figure 4:
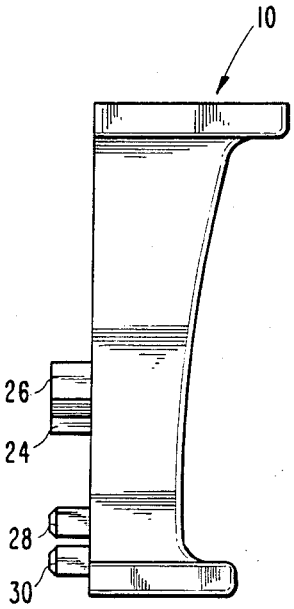
FIG. 4 is a right side plan view of the pre-molded electrical plug body piece of FIG. 1.
Figure 2:
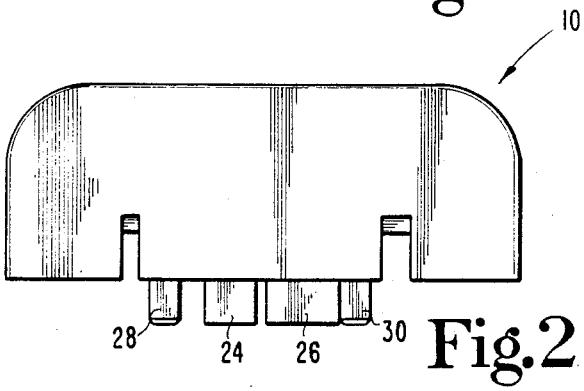
FIG. 2 is a front elevational view of the pre-molded electrical plug body piece of FIG. 1.
Figure 3:
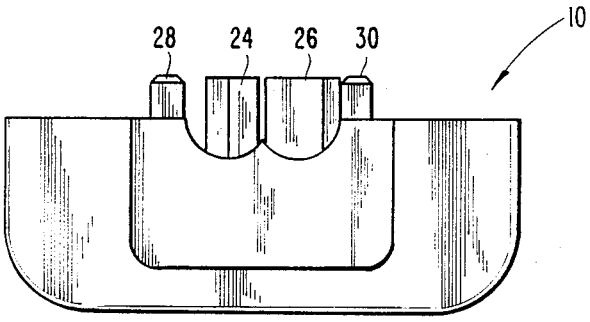
FIG. 3 is a rear elevational view of the pre-molded electrical plug body piece of FIG. 1.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings, there is shown in FIGS. 1–7 a preferred embodiment of the pre-molded electrical plug body piece 10 and pre-molded electrical plug body 12 (FIG. 5) of the present invention. The pre-molded electrical plug body 12 (FIG. 5) of the present invention is formed by mating together two identical pre-molded body pieces 10 (FIG. 1–4), thereby eliminating the need to pre-mold two different pieces to form the top and bottom of electrical plug body 12.

Figure 6:
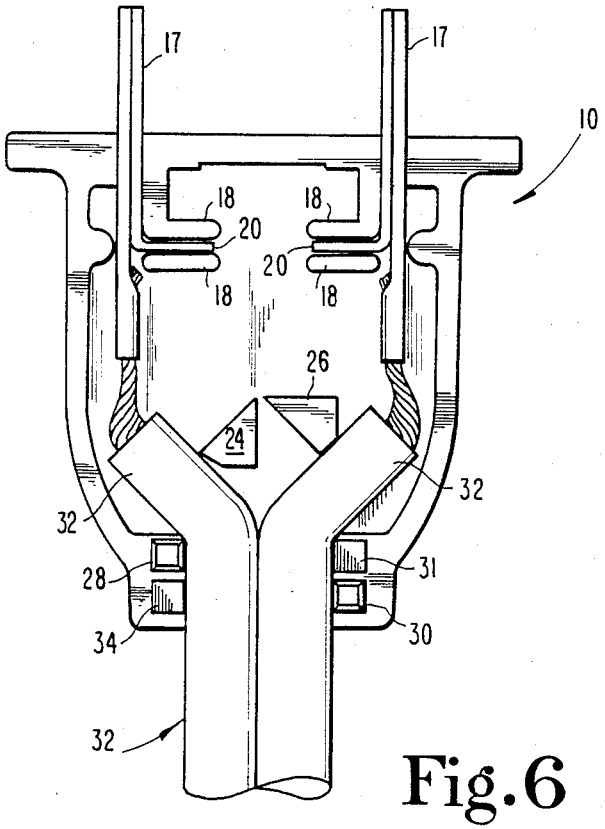
FIG. 6 is a top plan view of the pre-molded electrical plug body piece of FIG. 1 with electrical blades and wires in place.

Each pre-molded electrical plug body piece 10 is provided with blade receiving means 14 for snugly receiving conventional male electrical blades 17 (FIG. 6) into the electrical plug body piece 10. In the preferred embodiment, the male blade receiving means 14 include a pair of slots 16, formed by parallel fingers 18, into which the transversal male blade strain relief lips 20 of the male blades 17 are received (FIG. 6). Additionally, tabs 22 are provided to interact with notches present in the male blades 17. Together, slots 16 and tabs 22 allow male blades 17 to be guided into a snug and arresting relationship with pre-molded body piece 10 without the need for additional attachment means (FIG. 6).

Referring again to FIG. 1, each pre-molded electrical plug body piece 10 of the preferred embodiment is also provided with a pair of trapezium-shaped posts 24 and 26 and a pair cooperating pins 28 and 30. Referring now to FIG. 6, when male blades 17 with attached wires 32 are received into blade receiving means 14, posts 24 and 26 and pins 28 and 30 cooperate to arrest wires 32 therebetween, permitting this combination (FIG. 6) to be moved along a production line without male blades 17 or wire 32 becoming dislodged from the pre-molded electrical plug body piece 10.

Figure 5:
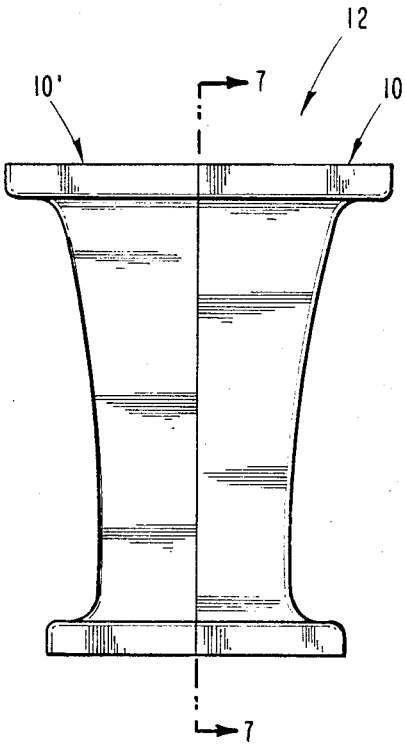
FIG. 5 is a right side plan view of two pre-molded electrical plug body pieces of FIG. 1 joined together in a mirror image relationship.
Figure 7:
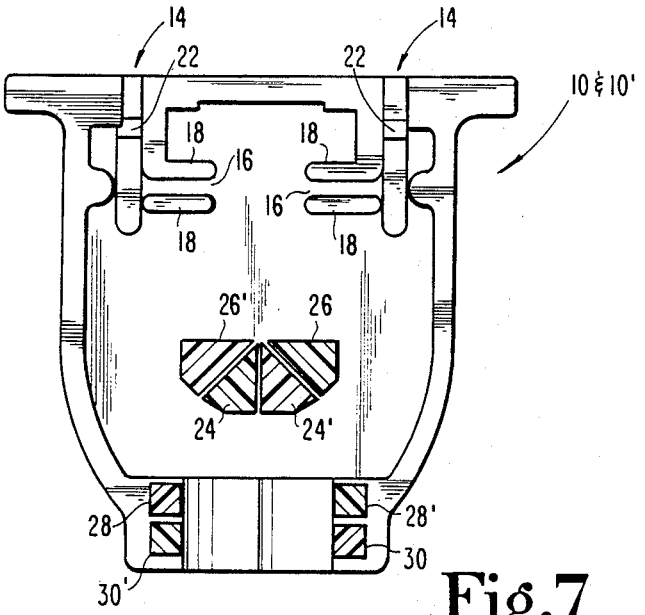
FIG. 7 is a cross-sectional view of the two pre-molded electrical plug body pieces of FIG. 5 taken along line 7—7 in the direction of the arrows.

The shapes and locations of the trapezium-shaped posts 24 and 26 and cooperating pins 28 and 30 of pre-molded electrical plug body piece 10 of the preferred embodiment are carefully selected such that when two pre-molded electrical plug body pieces 10 are mated together as shown in FIG. 5 (10+10') to form the pre-molded electrical plug body 12 of the preferred embodiment, trapezium-shaped posts 24 and 26 mate in nesting relationship with the corresponding trapezium-shaped posts 24' and 26' of an identical pre-molded electrical body piece 10' (FIG. 7). In similar fashion, pins 28 and 30 of pre-molded electrical plug body piece 10 are received into correspondingly sized recesses 31 and 34 of an identical pre-molded electrical plug body piece 10'. Likewise, pins 28' and 30' of pre-molded electrical plug body piece 10' are received into correspondingly sized recesses 31 and 34 of the identical pre-molded electrical plug body piece 10. Also, slots 16' and tabs 22' of pre-molded electrical plug body piece 10' allow male blades 17 to be received into a snug and arresting relationship with the identical pre-molded plug body piece 10', thus providing enough bonding strength between pre-molded electrical plug body pieces 10 and 10' to permit this mated combination to be moved along to the next manufacturing station, without inadvertent disassembly of the combination, where the mated pre-molded electrical plug body pieces 10 and 10' are welded together by conventional means, such as, for example, ultrasonic means or bonding agents or solvents, or the like.

The nesting relationship of trapezium-shaped posts 24 and 26 of pre-molded electrical body piece 10 with trapezium-shaped Posts 24' and 26' of an identical pre-molded electrical body piece 10' (FIG. 7) forms a strong central pillar that serves to arrest wires 32 in place and to provide strain relief to avoid stress being placed on the electrical wires 32 and male electrical blades 17.

The pre-molded electrical plug body piece 10 of the present invention may be formed from a suitable plastic material on a standard molding machine. In work completed to date, an acrylnitryl butadiene styrene plastic has been preferred.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. For example, the central pair of posts (24, 26) could be also triangular shaped or have rounded sides. The pins (28, 30) could be also triangular or round shaped.

What is claimed is:

1. A pre-molded electrical plug body to house male electrical blades and electrical plug wires, comprising a pair of identical pre-molded electrical plug body pieces mated together, each piece having blade receiving means for snugly receiving male electrical blades, a pair of posts nested together with corresponding posts of the mating piece to form a central pillar around which electrical plug wires are led to the male electrical blades, and a pair of pins received into corresponding recesses of the mating piece that cooperate with said pair of posts to arrest therebetween electrical plug wires led to the male electrical blades.

2. The pre-molded electrical plug body of claim 1 wherein said pair of posts are trapezium-shaped.

3. The pre-molded electrical plug body of claim 1 wherein said pins are rectangularly-shaped.

4. A pre-molded electrical plug body piece to house male electrical blades and electrical plug wires when mated with an identical pre-molded electrical plug body piece, comprising blade receiving means for snugly receiving male electrical blades, a pair of central posts around which electrical plug wires are led to the male electrical blades, and a pair of pins cooperating with said pair of posts to arrest therebetween electrical plug wires led to the male electrical blades.

5. The pre-molded electrical plug body of claim 4 wherein said pair of posts are trapezium-shaped.

6. The pre-molded electrical plug body of claim 4 wherein said pins are rectangularly-shaped.

7. A method of forming a pre-molded electrical plug body to house male electrical blades and electrical plug wires, comprising the steps of providing a pair of identical pre-molded electrical plug body pieces to be mated, each piece having blade receiving means for snugly receiving male electrical blades, a pair of posts to nest together with corresponding posts of the mating piece to form a central pillar around which electrical plug wires are led to the male electrical blades, and a pair of pins to be received into corresponding recesses of the mating piece that cooperate with said pair of posts to arrest therebetween the electrical plug wires led to the male electrical blades;

inserting male electrical blades and electrical plug wires within one of said pre-molded electrical plug body pieces;

mating the other pre-molded electrical plug body piece to the piece within which male electrical blades and electrical plug wires have been inserted; and welding the mated pre-molded electrical plug body pieces together.

8. The method of claim 7 wherein said providing step includes providing a pair of pre-molded electrical plug body pieces to be mated in which said pair of posts are trapezium-shaped.

9. The method of claim 7 wherein said providing step includes providing a pair of pre-molded electrical plug body pieces to be mated in which said pair of pins are rectangularly-shaped.

* * * * *